US005115165A

United States Patent [19]

Knoble

[11] Patent Number: 5,115,165

[45] Date of Patent: May 19, 1992

[54] SAFETY LIGHTING MEANS FOR USE WITH A HIGH INTENSITY DISCHARGE LAMP

[75] Inventor: David W. Knoble, East Flat Rock, N.C.

[73] Assignee: General Electric Company, Schenectady, N.Y.

[21] Appl. No.: 494,389

[22] Filed: Mar. 16, 1990

[51] Int. Cl.[5] ..... H05B 41/46

[52] U.S. Cl. ..... 315/92; 315/88; 315/135; 315/136; 315/276

[58] Field of Search ..... 315/88, 92, 93, 129, 315/135, 136, 276, 278; 307/38, 41

[56] References Cited

U.S. PATENT DOCUMENTS

| | | | |
|---|---|---|---|
| 3,611,432 | 10/1971 | Babcock et al. | 315/88 X |
| 3,636,404 | 1/1972 | Appleton | 315/88 X |
| 3,737,720 | 6/1973 | Willis, Jr. | 315/92 X |
| 3,873,882 | 3/1975 | Gershen | 315/92 |
| 3,927,348 | 12/1975 | Zawadski | 315/88 |
| 4,047,076 | 9/1977 | McNamara, Jr. | 315/88 |
| 4,099,095 | 7/1978 | Turner | 315/87 X |

*Primary Examiner*—Eugene R. LaRoche
*Assistant Examiner*—Do Hyun Yoo
*Attorney, Agent, or Firm*—George E. Hawranko; Stanley C. Corwin; Fred Jacob

[57] ABSTRACT

This safety lighting arrangement is especially suited for use with variously rated HID light sources having current ratings ranging from relatively low to relatively high values. The safety light arrangement includes a current transformer having a magnetizable core, a primary winding inductively coupled to the core for connection in series with the primary circuit in which the HID light source is connected, and a secondary winding inductively coupled to the core. The core is saturable by the primary winding current present when the current through the HID light source is as low as the current rating of one of the relatively low rated HID sources. The safety light arrangement also includes a monitoring relay connected across the secondary winding and maintained in an activated condition when the primary winding is traversed by current producing saturation of the core. This monitoring relay is set to drop out when current through the primary winding and the HID source is interrupted by a power interruption. The monitoring relay controls an auxiliary light source serving as a safety light. An energizing circuit for the auxiliary light source is effective to operate the auxiliary light source when the monitoring relay has dropped out but is rendered ineffective to operate the auxiliary light source when the monitoring relay is activated.

13 Claims, 3 Drawing Sheets

Fig. 1
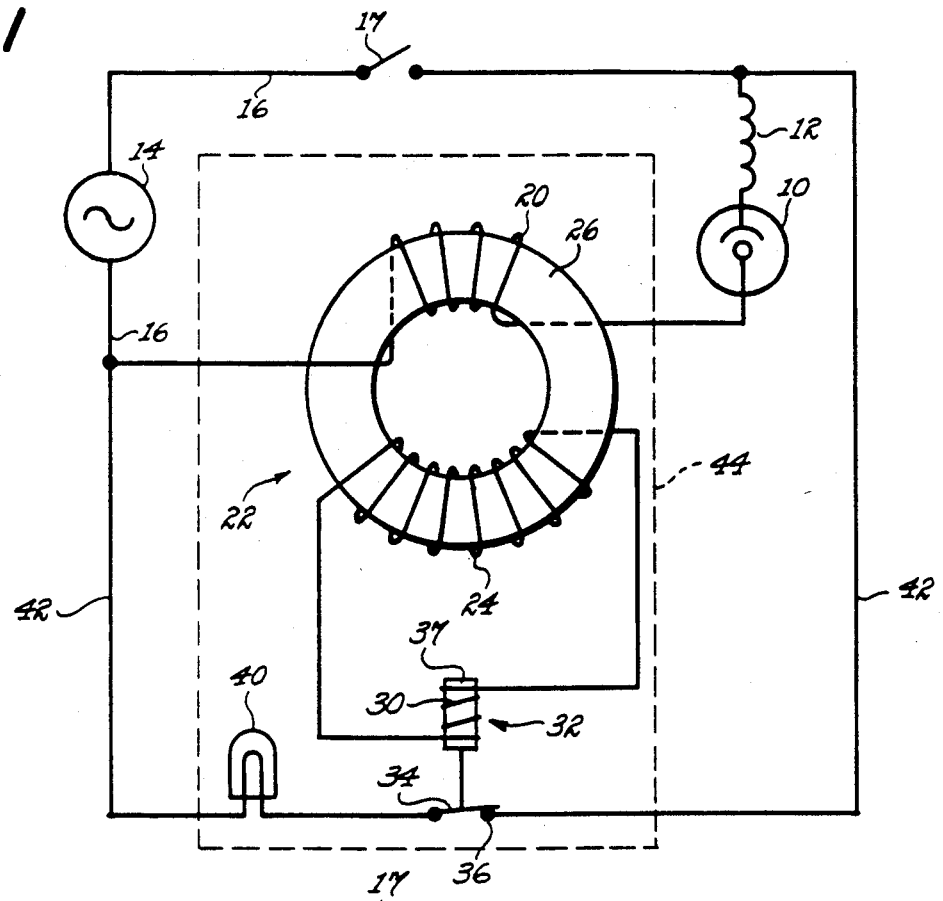
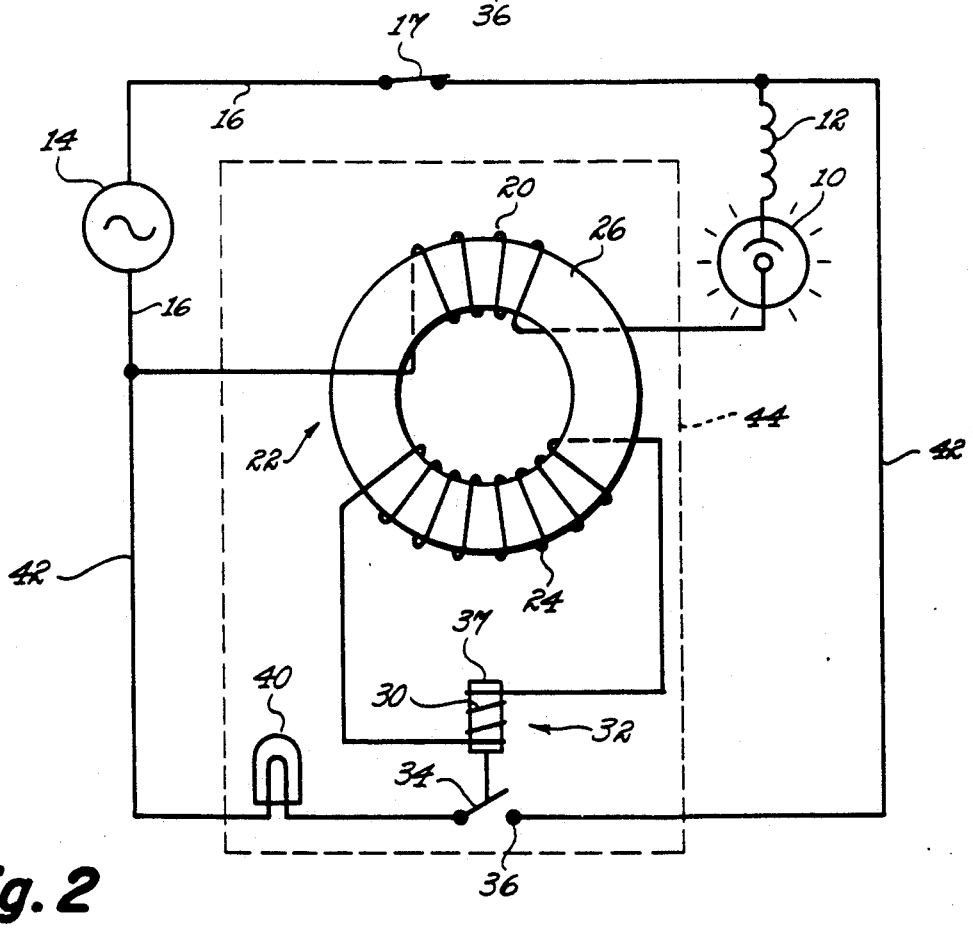
Fig. 2

Fig. 3
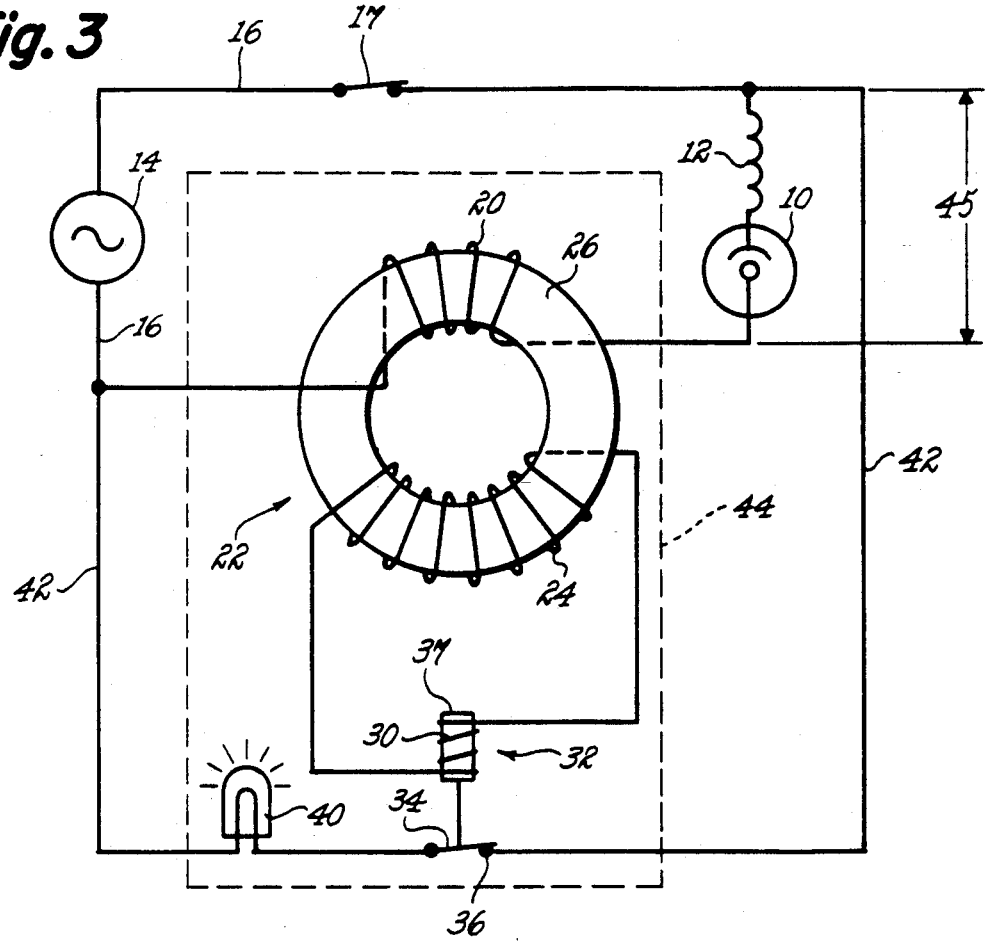
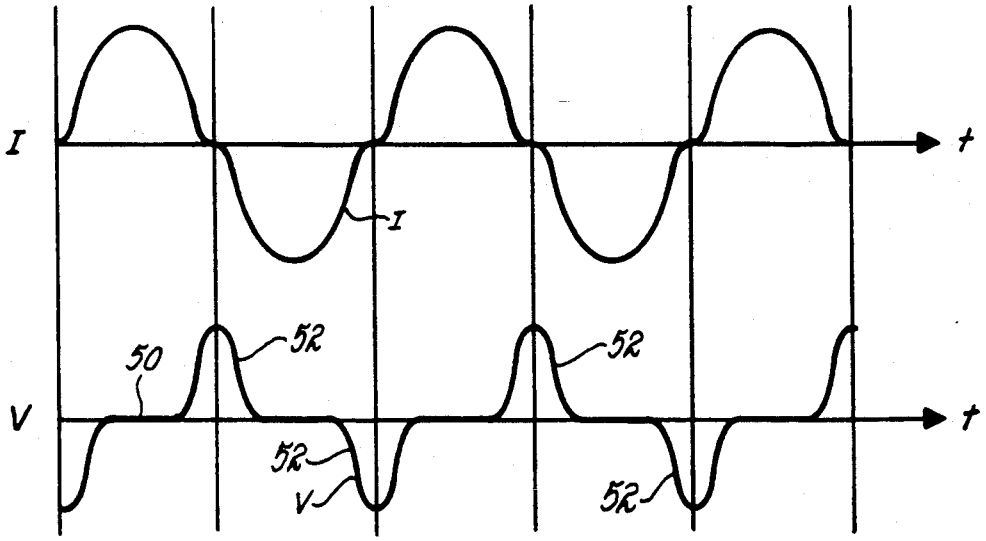
Fig. 4

Fig. 5
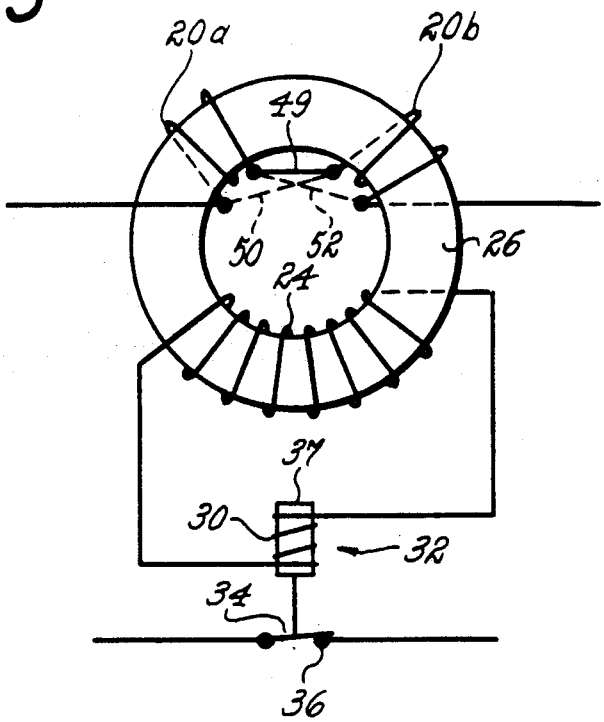
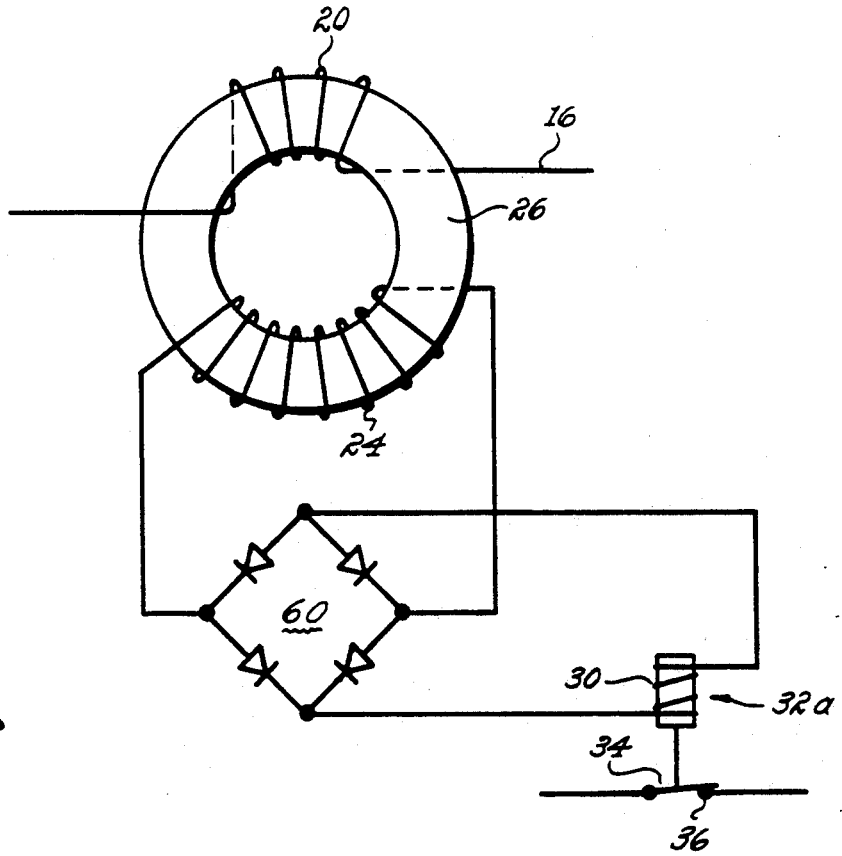
Fig. 6

SAFETY LIGHTING MEANS FOR USE WITH A HIGH INTENSITY DISCHARGE LAMP

This invention relates to safety lighting means for use with a primary light source comprising a high intensity discharge (HID) lamp. More particularly, the invention relates to safety lighting means of this type which is effective to provide a minimum light level during the interval when there is no light output from the HID lamp upon re-energization of such lamp following a brief power interruption.

BACKGROUND

Typically, most of the power interruptions to which lamps are subjected are of very brief duration, e.g., under one second, but even an interruption of this brief duration will cause a typical HID lamp to be extinguished. If the usual HID lamp is subjected to such a brief power interruption, it does not immediately reignite upon restoration of normal voltage thereacross. Typically, some cooling of the gases within the HID lamp will be required before the lamp will reignite in response to voltage applied thereacross. When the HID lamp does reignite in response to such voltage, its lumen output at the time of reignition is only a small fraction of normal. Gradually, this lumen output increases until the lamp regains its full brightness.

OBJECTS

An object of my invention is to provide, for use with an HID lamp, safety lighting means which is effective to provide a minimum level of light during the interval when the lamp remains extinguished following reapplication of voltage after a brief power interruption.

Another object is to provide safety lighting means capable of functioning as in the immediately-preceding object and requiring no time delay means for delaying turn-off of the safety light following reignition of the HID lamp.

Still another object is to provide safety lighting means which can effectively accomplish the above objects when used with any one of a variety of HID lamps ranging in rating from a relatively low wattage to a relatively high wattage. By attaining this objective, I can simplify the manufacture of luminaires which utilize safety lighting means in association with HID lamps.

Still another object is to provide, for use with an HID lamp, reliable and inexpensive safety lighting means that contains few components, all of simple and inexpensive construction.

SUMMARY

In carrying the invention in one form, I provide safety lighting means for use with variously rated HID light sources having r.m.s. current ratings ranging from a relatively low value to a relatively high value, which HID light sources are, respectively, adapted to be connected in a primary a.c. circuit for supplying current to the particular HID light source connected therein. The safety lighting means comprises a current transformer comprising a magnetizable core, a primary winding inductively coupled to the core for connection in series with said primary circuit and the HID light source therein, and a secondary winding inductively coupled to said core and having a substantially greater number of turns than said primary winding. The core is saturable by the primary winding current that is present when the current through said HID light source is as low as the r.m.s. current rating of one of said relatively low rated HID light sources, whereby the output voltage developed across said secondary winding when the core is thus saturated comprises a train of voltage pulses, one for each zero crossing of the primary winding current. The safety lighting means also includes a monitoring relay connected in circuit with said secondary winding so as to derive its operating energy from said current transformer and maintained in an activated condition when said primary winding is traversed by primary winding current producing saturation of said core. The monitoring relay is set to drop out when current through said primary winding and said HID light source is interrupted by a power interruption. The safety lighting means also comprises an auxiliary light source and energizing means for the auxiliary light source that is effective to operate the auxiliary light source when the monitoring relay has dropped out but is rendered ineffective to operate the auxiliary light source when the monitoring relay is activated.

When the HID lamp is extinguished as a result of a power interruption, the previously-activated monitoring relay drops out. Accordingly, when voltage is reapplied to the HID lamp after the power interruption has terminated, this voltage, applied to said energizing means, acts to turn on the auxiliary light source and to provide safety lighting while the still-extinguished HID lamp is cooling in preparation for reignition. When the HID lamp does finally reignite, the monitoring relay is immediately activated, thus rendering the energizing means for the auxiliary light source ineffective and, accordingly, turning off the auxiliary light source.

BRIEF DESCRIPTION OF FIGURES

For a better understanding of the invention, reference may be had to the following detailed description taken in conjunction with the accompanying drawings, wherein:

FIG. 1 is a schematic diagram of a lighting system comprising an HID lamp (10) and safety lighting means embodying one form of my invention. The lighting system is depicted in FIG. 1 in an off state, its on-off switch 17 being open.

FIG. 2 is a schematic diagram of the lighting system of FIG. 1 with the on-off switch 17 in a closed condition and the HID lamp in a turned-on state.

FIG. 3 is a schematic diagram of the lighting system of FIGS. 1 and 2 showing its components immediately after a brief power interruption but before the HID lamp 10 has cooled sufficiently to allow it to reignite in response to the voltage at 45 being applied thereto.

FIG. 4 is a timing diagram showing the voltage developed across the secondary winding (24) of the current transformer (22) of FIGS. 1–3 when a current I traverses its primary winding (20).

FIG. 5 illustrates a modified form of the invention.

FIG. 6 illustrates another modified form of the invention.

DETAILED DESCRIPTION OF EMBODIMENTS

Referring now to FIG. 1, there is shown a high intensity discharge (HID) lamp 10 and a conventional ballast 12 connected in series in a primary circuit 16 that is connected across the terminals of a source 14 of a.c. voltage. The lamp 10 may be thought of as a primary light source. For simplicity, the ballast 12 is depicted as a simple inductance.

For turning the lamp off and on, a manually-operable switch 17 is connected in the primary circuit in series with the lamp 10 and ballast 12. In FIG. 1, switch 17 is shown in its open, or off, condition.

Also connected in the primary circuit 16 in series with the lamp 10 is the primary winding 20 of a current transformer 22 comprising a secondary winding 24 and a saturable iron core 26 to which the two windings 20 and 24 are inductively coupled in a conventional manner. Secondary winding 24 has a substantially greater number of turns than primary winding 20. Connected across the secondary winding 24 so as to derive its operating energy from the current transformer 22 is the operating coil 30 of a normally-closed electromagnetic relay 32. This relay 32, which is of conventional design and is referred to hereinafter as a monitoring relay, comprises a set of separable contacts 34 and 36. Contact 36 is a stationary contact, and contact 34 is a movable contact coupled to the armature 37 of operating coil 30. When the operating coil 30 is energized by voltage exceeding a predetermined pick-up value applied thereacross, it activates the armature 37 and separates the contacts 36 and 34.

For providing a minimum level of light during certain intervals (soon to be described in more detail) when the primary light source 10 is extinguished, a safety light 40 is provided. In one form of the invention, this safety light 40 is an incandescent lamp, preferably of the quartz type. This safety light 40 is connected in an energizing circuit 42 in series with the contacts 36, 34 of the relay 32. In the illustrated form of the invention, the safety light 40 derives its power from the same power source 14 as the primary light source 10. Accordingly, the energizing circuit 42 is shown connected across the a.c. power source 14 and in parallel with the series combination of components 12, 10, and 20.

Under normal operating conditions, depicted in FIG. 2, current through the primary circuit 16 is an alternating current of sufficient amplitude so that in flowing through the primary winding 20 of the current transformer, it produces a sufficient voltage across the secondary winding 24 to hold the monitoring relay 32 in an activated condition in which its contacts 34, 36 are open. When the contacts 34, 36 are held open as shown in FIG. 2, the safety-light energizing circuit 42 is disabled and the safety light 40 is maintained in an off condition.

As pointed out hereinabove under BACKGROUND, if for any reason there should be a brief power interruption that causes the HID lamp 10 to be extinguished, restoration of normal voltage across the HID lamp immediately following this brief power interruption will not cause the lamp immediately to reignite. Typically, some cooling of the gases within the HID lamp will be required before the lamp will reignite in response to the voltage applied thereacross. When the HID lamp does reignite in response to such voltage, its lumen output at the time of reignition is only a small fraction of normal. Gradually, this lumen output increases until full brightness of the lamp is achieved.

FIG. 3 depicts the lighting system at an instant immediately following restoration of normal voltage but before the HID lamp 10 has reignited. In the interval immediately preceding that depicted in FIG. 3, the loss of voltage (at 45) that resulted from the power interruption had interrupted current through the current transformer primary winding 20, and this has caused the relay 32 to drop out and close its contacts 34, 36 as shown in FIG. 3. When voltage reappears at 45 following the power interruption, the safety light 40 is immediately turned on current through energizing circuit 42. After a short interval, the HID lamp is ignited, immediately producing a low level of light. Thereafter, the HID lamp gradually brightens and eventually produces its full lumen output.

As soon as the HID lamp 10 reignites, as above described, current through the lamp and the CT primary winding 20 in series with the lamp provides a sufficient voltage across the secondary winding 24 to pick up the relay 37, thus opening the relay contacts 36, 34 and interrupting the energizing circuit 42 for the safety light 40. Accordingly, the safety light 40 is extinguished as soon as the HID lamp is reignited.

During the period between turn-off of the safety light 40 and the time when the HID lamp achieves full brightness, the HID lamp itself is acting to provide safety lighting. No assistance during this interval is received from safety light 40 since it was turned off immediately upon reignition of the HID lamp. By turning off the safety light 40 immediately upon reignition of the HID lamp 10 and relying thereafter upon the low level, but gradually increasing, output from the HID lamp, I am able to eliminate the need for the time-delay means customarily present in prior safety lighting arrangements for HID lamps, e.g., the time delay means illustrated at 11, 12 in U.S. Pat. No. 4,099,095-Turner, assigned to the assignee of the present invention.

In some applications, even though extra components are required, it may still be desirable to delay turnoff of the safety light 40 during the period when the HID lamp 10 is recovering its full brightness. Accordingly, my invention in its broader aspects comprehends using suitable time delay means to delay activation of the monitoring relay after current flow through the primary winding 20 is resumed upon reignition of the HID lamp.

It should be noted that the monitoring relay 32 derives its operating energy from the current transformer 22 and requires no separate source of energy or separate control for its operation. This materially contributes to the simplicity and reliability of my safety lighting means, partially as a result of the reduced number of components required.

The current transformer 22, the monitoring relay 32, the safety light 40, and the energizing circuit 42 for the safety light are all assembled on a suitable insulating board, and this composite assembly is referred to hereinafter as a safety lighting board. This safety light board is indicated at 44 in FIG. 1.

It is highly desirable that a single design of safety lighting board be usable with a variety of HID lamps, e.g., HID lamps rated from 35 watts to 400 watts. This adaptability enables the manufacturer of the lighting system to greatly reduce the variety of safety lighting boards required to be carried in its inventory and also reduces the need to watch safety lighting boards with HID lamps, both of which factors simplify manufacturing of the lighting system and reduce manufacturing cost.

I am able to rely upon a simple readily-adaptable design of safety lighting board because I employ a current transformer (22) for supplying operating energy to and controlling the monitoring relay (32) and also because 1 employ a current transformer that is capable of effectively regulating the voltage applied to the monitoring relay 32 so that this voltage has an effective value that changes very little irrespective of whether a low rated or high rated HID lamp is connected in the primary circuit 16.

Effective regulation of the voltage applied to this coil 30 of the monitoring relay 32 is achieved by utilizing an iron core (26) for the current transformer 22 that saturates when the current through the primary winding 20 is relatively low. More specifically, even when a primary light source 10 of the lowest rating contemplated for use with the safety lighting board 44 is employed, the core 26 saturates on each half-cycle loop of current through primary winding 20.

As shown in FIG. 4, the output voltage 50 appearing across the secondary winding 24 comprises a train of pulses 52, each pulse beginning when the core comes out of saturation as the primary current I, depicted in FIG. 4, approaches zero and terminating when the core is driven back into saturation after current zero. The peak value and width of these pulses 52 varies slightly depending upon the value of the primary current I. But for primary currents of between one ampere and five amperes r.m.s., the r.m.s. value of the output pulse train varies only by about 50 percent, and as a direct function of the primary current.

Another feature that enables my safety lighting board 44 to be used with primary light sources varying in current rating over a wide range (e.g., from about one ampere to about five amperes) is that I use for the primary winding 20 wire of sufficient cross-section that no overheating of the current transformer occurs even when the primary winding is continuously traversed by the highest rated current, i.e., the 5 ampere current.

In another embodiment of the invention, depicted in FIG. 5, the current transformer (22) employs a dual-section primary winding instead of the single-section primary winding 20 of FIGS. 1-3. This dual-section primary winding comprises two primary winding sections 20*a* and 20*b* with means for selectively connecting the two winding sections either in parallel or in series. When solid-line connection 49 of FIG. 5 is in place, the two winding sections 20*a* and 20*b* are connected in series. When the solid line connection 49 is removed and the two dotted line connections 50 and 52 are introduced, the winding sections are connected in parallel. In the illustrated embodiment the winding sections 20*a* and 20*b* have an equal number of turns. For low current applications, the two winding sections are connected in series; and for high current applications, the two winding sections are connected in parallel. By switching from the series connection for a primary current rating of x to the parallel connection for a primary current rating of 2x a substantially equal number of primary ampere-turns can be provided for these two current ratings. Such switching enables me to maintain the output voltage of the transformer more nearly constant when the transformer is used for the higher, instead of the lower, primary current ratings.

In the embodiment of FIGS. 1-3, the monitoring relay is an a.c. relay 32. I can reduce the cost of the safety lighting board 44 by using for the monitoring relay a d.c. relay, such as shown at 32*a* in FIG. 6, connected across the output terminals of a full-wave diode bridge 60 having input terminals connected across the secondary winding 24 of the current transformer. The d.c. relay - diode bridge combination is less expensive than a comparable a.c. relay. The voltage appearing across the output terminals of the diode bridge is a unidirectional pulsating voltage that is applied to the coil 30 of the d.c. relay 32*a*, such voltage being smoothed by the inductive relay coil.

In the embodiment of FIGS. 1-3, the safety light 40 derives its power from the same source (14) as the HID lamp 10. If this power source 14 is disabled, then the safety light 40 will be deprived of power so long as the source 14 is disabled. But, if it is desired to turn on the safety light whenever the HID lamp is extinguished, a separate source can be provided for the energizing circuit 42 for the safety light. In such an arrangement, the safety light 40 will be turned on whenever current through the HID lamp is interrupted and will be turned off whenever there is current through the HID lamp. In most installations, the safety light will be powered from the same source as the HID lamp since the power interruptions typically encountered by the HID lamp are of such brief duration that they can be tolerated if effective safety lighting is present.

While I have shown and described particular embodiments of my invention, it will be obvious to those skilled in the art that various changes and modifications may be made without departing from my invention in its broader aspects; and I, therefore, intend herein to cover all such changes and modifications as fall within the true spirit and scope of my invention.

What I claim as new and desire to secure by Letters Patent of the United States is:

1. Safety lighting means for use with variously rated HID light sources having current ratings ranging from a relatively low value to a relatively high value, the HID light sources being respectively adapted for connection in a primary a.c. circuit for supplying current to the HID light source connected therein; the safety lighting means comprising:

(a) a current transformer comprising a magnetizable core, a primary winding inductively coupled to said core for connection in series with said primary a.c. circuit and said HID light source, and a secondary winding inductively coupled to said core, the secondary winding having a substantially greater number of turns than said primary winding, (b) a monitoring relay connected in series circuit with said secondary winding so as to derive the relay's operating energy solely from said current transformer and operable into an activated condition by energy derived from said current transformer in response to said primary winding being traversed by a predetermined minimum value of primary current, said relay being operable to a deactivated condition in response to interruption of said primary current by a power interruption, (c) an auxiliary light source serving as a safety light, and (d) energizing means for said auxiliary light source that (i) is effective to operate said auxiliary light source when said relay is in a deactivated condition but (ii) is rendered ineffective to operate said auxiliary light source when said relay is operated into its activated condition, said monitoring relay being operated to said activated condition immediately upon establishment of said predetermined minimum value of primary current such that said auxiliary light is extinguished without time delay.

2. The safety lighting means of claim 1 in which said core effectively saturates when said primary winding is traversed by primary currents as low as those present when the r.m.s. current through said HID source is as low as the r.m.s. current rating of one of said relatively low rated HID light sources.

3. The safety lighting means of claim 1 in combination with rectifying means for converting the output of said secondary winding to an unidirectional voltage and means for applying said unidirectional voltage to said monitoring relay.

4. The safety lighting means of claim 1 in which:

(a) said secondary winding has output terminals, (b) primary current flow through said primary winding produces an alternating voltage across said output terminals, and (c) rectifying means is provided in circuit with said output terminals for converting said alternating voltage to an unidirectional voltage that is applied to said monitoring relay for operating said relay.

5. The safety lighting means of claim 1 in which:

(a) a power interruption interrupts primary current through said primary winding and causes said HID light source connected in said primary circuit to be extinguished, thereby deactivating said monitoring relay and causing said energizing means to operate said auxiliary light source, (b) reignition of said HID light source after a power interruption allows primary current through said primary winding to be resumed, and (c) wherein, when said monitoring relay is operated into its activated condition essentially without time delay, thereby extinguishing said auxiliary light source, said reignited HID light source provides continued safety lighting without assistance from said auxiliary light source.

6. The safety lighting means of claim 1 in which operation of said auxiliary light source is stopped immediately after reignition of the connected HID light source following a power interruption, thereby causing said reignited HID light source to provide continued safety lighting without assistance from said auxiliary light source during the period after reignition while the HID source is recovering its full brightness.

7. Safety lighting means for use with variously rated HID light sources having r.m.s. current ratings ranging from a relatively low value to a relatively high value, the HID light sources being respectively adapted for connecting in a primary a.c. circuit for supplying current to the particular HID light source connected therein, the safety lighting means comprising:

(a) a current transformer comprising a magnetizable core, a primary winding inductively coupled to said core for connection in series with said primary a.c. circuit and said HID light source, and a secondary winding inductively coupled to said core, the secondary winding having a substantially greater number of turns than said primary winding, the core being saturable by the primary current traversing said primary winding that is present when r.m.s. current through said HID light source is as low as the r.m.s. current rating of one of said relatively low rated HID light sources, whereby the output voltage developed across said secondary winding by said primary current comprises a train of voltage pulses, (b) a monitoring relay connected in circuit with said secondary winding so as to derive the relay's operating energy from said current transformer and maintained in an activated condition by said train of voltage pulses when said primary winding is traversed by primary current producing saturation of said core, said monitoring relay being operable to a deactivated condition in response to interruption of said primary current by a power interruption, (c) an auxiliary light source serving as a safety light, (d) energizing means for said auxiliary light source that (i) is effective to operate said auxiliary light source when said monitoring relay is in a deactivated condition but (ii) is rendered ineffective to operate said auxiliary light source when said monitoring relay is operated into an activated condition and, (e) wherein said primary winding comprises two winding sections that are adapted to be connected in series when a relatively low rated HID lamp is connected in said primary circuit and are adapted to be connected in parallel when a relatively high rated HID lamp is connected in said primary circuit.

8. The safety lighting means of claim 7 in which: said core is saturable by the primary current traversing said primary winding that is present when the lowest rated of said HID light sources is present in said primary a.c. circuit and rated r.m.s. current is flowing through said lowest rated HID light source.

9. The safety lighting means of claim 7 in which said primary winding comprises a conductor of large enough cross-section that it can continuously carry the primary current that flows therethrough when the highest rated of said HID light sources is present without overheating of the current transformer.

10. The safety lighting means of claim 7 in which:

(a) said secondary winding has output terminals, (b) primary current flow through said primary winding produces an alternating voltage across said output terminals, and (c) rectifying means is provided in circuit with said output terminals for converting said alternating voltage to an unidirectional voltage that is applied to said monitoring relay for operating said relay.

11. The safety lighting means of claim 7 in which said HID light sources having current ratings of relatively low value are rated at about 1 ampere r.m.s. and said HID light sources having current ratings of relatively high value are rated at about 5 amperes r.m.s.

12. The safety lighting means of claim 9 in which said HID light sources having current ratings of relatively low value are rated at about 1 ampere r.m.s. and said HID light sources having current ratings of relatively high value are rated at about 5 amperes r.m.s.

13. The safety lighting means of claim 7 in which said HID light sources having current ratings of relatively low value are rated at about 1 ampere r.m.s. and said HID light sources having current ratings of relatively high value are rated at about 5 amperes r.m.s.

* * * * *